US005190625A

United States Patent [19]

Seon et al.

[11] Patent Number: 5,190,625

[45] Date of Patent: Mar. 2, 1993

[54] ELECTROLYTIC PRODUCTION OF RARE EARTH METALS/ALLOYS THEREOF

[75] Inventors: Francoise Seon, Montreuil; Ghislaine Barthole, Saint-Mande, both of France

[73] Assignee: Rhone-Poulenc Specialites Chimiques, Courbevoie, France

[21] Appl. No.: 879,114

[22] Filed: May 4, 1992

Related U.S. Application Data

[63] Continuation of Ser. No. 631,479, Dec. 21, 1990, abandoned, which is a continuation of Ser. No. 497,828, Mar. 22, 1990, abandoned, which is a continuation of Ser. No. 806,289, Dec. 9, 1985, abandoned.

[30] Foreign Application Priority Data

Dec. 7, 1984 [FR] France ..... 84 18700

[51] Int. Cl.[5] ..... C25C 3/00; C25C 3/34

[52] U.S. Cl. ..... 204/64 R; 204/71

[58] Field of Search ..... 204/64 R, 71

[56] References Cited

U.S. PATENT DOCUMENTS 2,961,387 11/1960 Slatin ..... 204/64 R
4,139,427 2/1979 Greinacher ..... 204/64 R

FOREIGN PATENT DOCUMENTS 0773491 4/1957 United Kingdom ..... 204/64 R

OTHER PUBLICATIONS

Morrice et al., "Fused-Salt Electrowinning and Electrorefining of Rare-Earth and Yttrium Metals", Minerals Sci. Engng., vol. 11, No. 3 (Jul. 1979).

*Primary Examiner*—John Niebling
*Assistant Examiner*—David G. Ryser
*Attorney, Agent, or Firm*—Burns, Doane, Swecker & Mathis

[57] ABSTRACT

The rare earth metals, or alloys thereof, are prepared in high yields in a specially designed electrolytic cell, by electrolyzing a melt comprising (i) at least one chloride of at least one rare earth, or at least one such chloride and at least one chloride of at least one transition metal, (ii) at least one alkali or alkaline earth metal chloride, and (iii) at least one alkali or alkaline earth metal fluoride.

13 Claims, 1 Drawing Sheet

FIG. 1
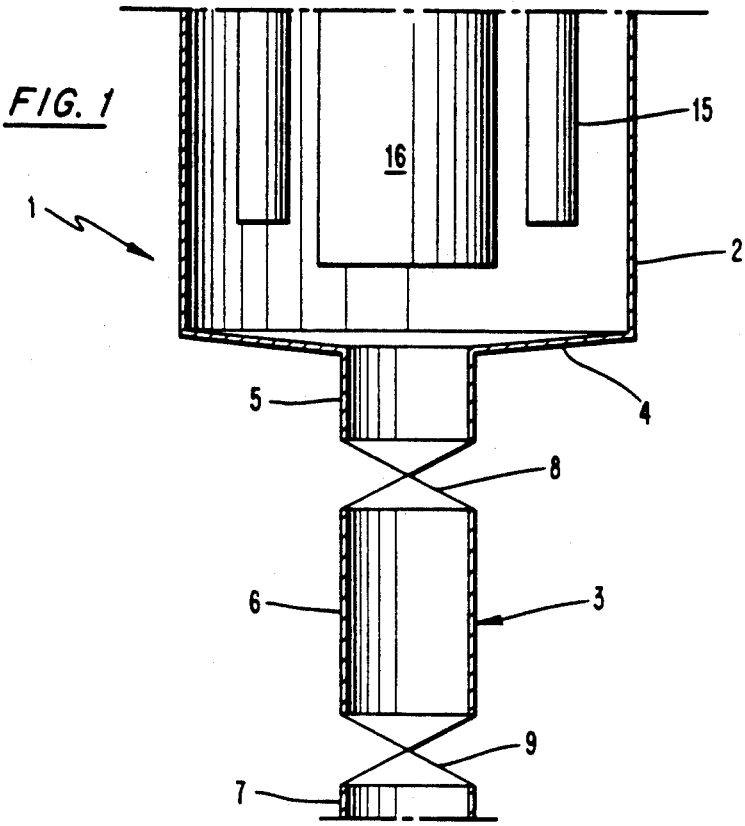
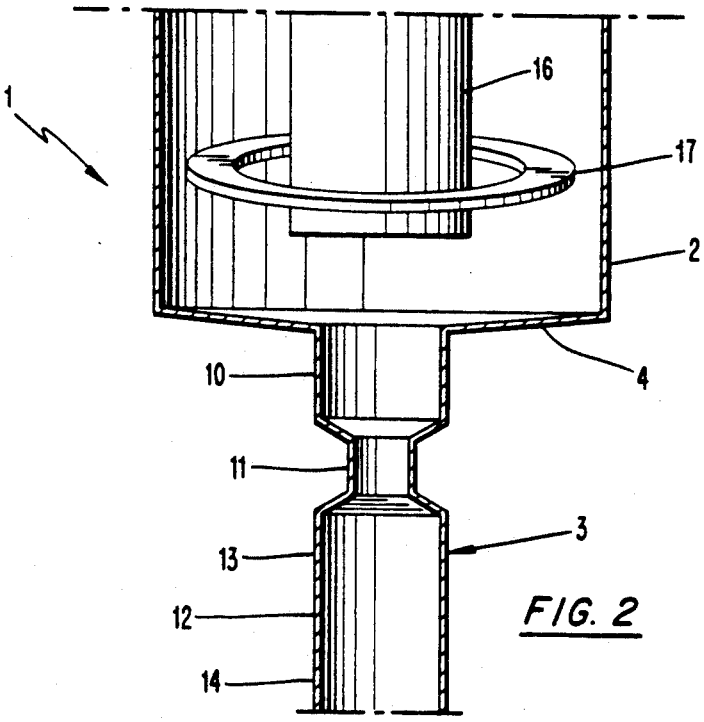
FIG. 2

ELECTROLYTIC PRODUCTION OF RARE EARTH METALS/ALLOYS THEREOF

This application is a continuation of application Ser. No. 07/631,479, filed Dec. 21, 1990 now abandoned, which is a continuation of application Ser. No. 07/497,828, filed Mar. 22, 1990 (now abandoned), which is a continuation of Ser. No. 06/806,289, filed Dec. 9, 1985 (now abandoned).

BACKGROUND OF THE INVENTION

1. Field of the Invention

The present invention relates to an electrolytic process for the preparation, in baths of molten salts, of rare earths or alloys thereof, as well as to apparatus for carrying out such process.

As utilized herein, by the term "rare earths (RE)"- there is intended any element selected from the group consisting of yttrium and those lanthanides other than, or excepting samarium, europium, ytterbium and thullium.

2. Description of the Prior Art

At present, electrolysis in a molten medium of a rare earth chloride and in particular neodymium is problematical by virtue of the very low yields obtained. This is due to a high degree of solubility of the metal in the presence of its chloride. Such a process is described in the article by T. Kurita, *Denku Kagaku,* 35 (7), pages 496–501 (1967). The Kurita article refers to a yield, which does not attain 20%, of pure neodymium in the case of a molten bath constituted of neodymium chloride and potassium chloride.

SUMMARY OF THE INVENTION

Accordingly, a major object of the present invention is the provision of an improved process for the electrolytic production of a rare earth under condition such that the process can be carried out on an industrial scale.

Another object of the invention is the provision of a process for the preparation of alloys of rare earths which is also susceptible to being carried out on an industrial scale.

Yet another object of the invention is the provision of improved apparatus especially adopted to carry out the subject processes.

Briefly, the process according to the invention features the electrolysis, in a bath of molten salts, to prepare a rare earth or an alloy of a rare earth with at least one other rare earth metal, or transition metal, said bath comprising (i) at least one chloride of a rare earth, (ii) at least one alkali or alkaline earth metal chloride and (iii) at least one alkali or alkaline earth metal fluoride.

BRIEF DESCRIPTION OF THE DRAWINGS

FIG. 1 is a diagrammatic view, in cross-section, of a first embodiment of an electrolytic cell according to the invention; and FIG. 2 is a diagrammatic view, in cross-section, of a second embodiment of an electrolytic cell according to the invention.

DETAILED DESCRIPTION OF THE INVENTION

More particularly according to the invention, in a preferred embodiment thereof, the bath comprises lithium, at least as one alkali metal.

Additionally, the electrolytic cell according to the invention features a tank, the bottom of which is extended into a drain zone defined by a conduit whose internal cross-section is smaller than that of the tank.

In one particular embodiment of the invention, said conduit opens into the center of the bottom of the tank.

The process of the invention enables production of a metal at a good level of purity, or an alloy having a high proportion of rare earth. The metal yields are high, and can even exceed 80%, under conditions which are applicable at an industrial level.

As indicated hereinbefore, the invention features the preparation of metals and alloys of the rare earths, and is especially adopted for the production of metallic neodymium from neodymium chloride, in which case the yields of neodymium are markedly improved.

The invention also relates to the production of alloys and in particular the production of alloys based on neodymium.

The alloys which can thus be prepared are alloys of different rare earths, such as, for example, Nd-La, Nd-Ce or Nd-Pr, or alloys of one or more rare earths and a metal selected from the group constituting the transition metals. The transition metals that may be used include all metals which have a melting point which is higher than the temperature of the molten salt bath at the moment of electrolysis, which temperature, for example, may vary from 650° C. to 1,100° C. Exemplary of such metals, representative are iron, cobalt, nickel and chromium. Thus, according to the invention, the following specific alloys are conveniently prepared: Nd-Fe, La-Fe, Nd-La-Fe and Pr-Fe.

Consistent herewith, the starting point for the process is the chloride of the rare earth which is to be produced in metallic form. In order to produce an alloy comprising a plurality of rare earths, the starting point is then a bath comprising a mixture of the chlorides of each of such rare earths. These chlorides should preferably have a water content of less than 6% by weight.

The bath which is used for the electrolysis operation further comprises, other than the rare earth chloride or chlorides, one or more alkali metal or alkaline earth metal chlorides and one or more alkali metal or alkaline earth metal fluorides.

In a particularly preferred embodiment of the invention lithium is used as the alkali metal. The presence of lithium halide in the molten bath has the effect of markedly improving yields.

Finally, in an even more preferred embodiment of the invention, the bath comprises at least one lithium fluoride and lithium chloride. Such a bath typically gives the best yields.

The proportion of the rare earth chloride or chlorides in the bath may vary from 10 to 70% by weight, and more preferably from 15 to 45%.

In addition, the proportion by weight as between the alkali metal or alkaline earth metal chloride or chlorides, on the one hand, and the fluoride or fluorides on the other hand, preferably ranges from 1.5:1 to 3:1.

Advantageously, a bath is used which has a content of at least 15% by weight of one or more fluorides.

The temperature of the bath during electrolysis is fixed in such manner as to be higher than the melting temperature of the electrolytic bath.

Typically, that temperature ranges from 650° C .to 1,100° C., more particularly from 700° C. to 900° C.

The conditions of the electrolysis operation, per se, will now be described.

As regards the electrodes, the apparatus typically employs a graphite anode. The nature of the cathode may vary according to the type of product being prepared.

When preparing a pure rare earth, a tungsten cathode is advantageously employed. It is also possible to employ a cathode formed of the same rare earth as that which is to be prepared. Cathodes of the same type are used to prepare an alloy of different rare earths.

When preparing an alloy of a rare earth with a transition metal, the cathode will be a consumable cathode constituted of said transition metal, or of the same rare earth/transition metal alloy that is sought to be produced.

The voltage at the terminals of the electrodes typically ranges from 4 to 10 volts.

The cathodic current densities (ccd) may range from 70 $A.dm^{-2}$ to 700 $A.dm^{-2}$, more particularly from 100 to 250 $A.dm^{-2}$. The anodic current densities (acd) typically range from 50 to 250 $A.dm^{-2}$.

Moreover, it has been found to be advantageous to carry out the electrolysis operation under conditions such that there is a partial chlorine pressure in the gaseous phase of at least $1.01 \cdot 10^4$ Pa (0.1 atmosphere). In such a case, transformation of the oxychlorides present in the bath occurs in accordance with the reaction $REOCl + Cl_2 \rightarrow RECl_3 + \frac{1}{2} O_2$; in fact, the oxychlorides are introduced as impurities with the rare earth chlorides. In that case, the starting materials may be rare earth chlorides having an oxychloride content of up to 25% by weight.

In order to further illustrate the present invention and the advantages thereof, the following specific examples are given, it being understood that same are intended only as illustrative and in nowise limitative.

In said examples to follow, the experiments described were carried out in alumina crucibles with graphite anodes measuring from 10 to 25 mm in diameter; the interelectrode spacing was 65 mm in Examples 1 to 4. For each electrolysis operation, the metal produced was recovered after cooling in the crucible. The compositions of the baths are given in % by weight.

The specified metal yield designates the ratio of the rare earth metal obtained with respect to the metal corresponding to the rare earth chloride ($RECl_3$) introduced.

EXAMPLE 1

Production of Metallic Neodymium

The electrolysis of 800 g of a molten mixture having the following composition: $NdCl_3$:13.3%; Licl:62.0%; LiF:24.7%, was carried out at a temperature of 850° C. on a tungsten cathode ($\phi$=4 mm). The electrolysis operation was carried out using a current strength I of 8.5 A which corresponded to a cathodic current density (ccd) of 690 $A.dm^{-2}$ and an anodic current density (acd) of 60 $A.dm^{-2}$. The voltage at the terminals of the electrodes ranged from 4.6 to 5.0 volts. Electrolysis for 4 hours, providing a metal yield of 40%, gave 24.1 g of metal whose neodymium, lithium and tungsten contents were, respectively, 98%, 0.07% and $\leqq$1%.

EXAMPLE 2

Production of a Neodymium-Iron Alloy Having Low Iron Content 800 g of a bath having a composition very close to that corresponding to the mixture which was subjected to electrolysis in Example 1, $NdCl_3$:13%; LiCl:62%; LiF:25%, was used. The electrolysis operation was carried out at 730° C. using a cathode formed of 65 g of Nd/Fe alloy with 20% iron (the alloy was previously prepared by calciothermy). Electrical contact was made by means of a steel rod. The strength of the electrolysis current was high, 25 A, but corresponded only to a low ccd (110 $A.dm^{-2}$); the acd was 250 $A.dm^{-2}$. After electrolysis for 1 hour, 20 minutes, 48 g of metal were recovered (metal yield of 80.4%), containing at least 89% of Nd, 8.7% of iron and 0.1% of lithium.

EXAMPLE 3

Production of a Neodymium-Iron Alloy

The mass and the composition of the electrolysis bath, as well as the temperature selected were identical to those considered in Example 2 (the neodymium chloride containing 7.5% of oxychloride and 2.7% of water). The strength of the electrolysis current was lower (13.5 A). At the cathode, which consisted of a (consumable) iron grid and a steel contact, the ccd was 100 $A.dm^{-2}$. The value of the acd was 135 $A.dm^{-2}$. After electrolysis for 2 hours, 30 minutes, 50 g of metal were obtained (metal yield of 84%), containing at least 85% of Nd, 12% of iron and 0.7% of lithium.

In the following Examples (Examples 4 to 8), the duration of electrolysis is given with respect to "to" which is the time theoretically required for reduction of the entirety of the RECl if the metal yield were 100%.

EXAMPLE 4

Production of Pure Lanthanum

The starting point was a bath having the following composition: $LaCl_3$:13%; LiCl:62%; LiF:25%. The process employed cathode consisting of a bar of tungsten, while the ccd was 690 $A.dm^{-2}$ and the acd was 60 $A.dm^{-2}$. The interelectrode spacing was 65 mm, while the temperature was 800° C. After t=to, a metal was produced whose lanthanum content was at least 95%, the metal yield being 33%.

EXAMPLE 5

Production of a Lanthanum-Iron Alloy

The composition of the bath was as follows: $LaCl_3$:25%; LiCl:53%; LiF:22%. The cathode consisted of an iron bar while the ccd was 165 $A.dm^{-2}$, the acd was 215 $A.dm^{-2}$ and the interelectrode spacing was 60 mm. The temperature was 840° C. After t=1.5 to, an alloy was produced comprising 92% of La and 7% of iron. The yield in metal was 34%.

EXAMPLE 6

Production of a Neodymium-Lanthanum Alloy

The starting point was a bath having the following composition: $NdCl_3$:26%; $LaCl_3$:9%; LiCl:46%; LiF:19%. The cathode was a tungsten bar, the ccd was 276 $A.dm^{-2}$, the acd was 235 $A.dm^{-2}$ and the interelectrode spacing was 63 mm. The temperature was 860° C. After an electrolysis period of t=0.7 to, an alloy having the following composition was obtained, in a metal yield of 57%:Nd:81%; La:18%, with a lithium content of 0.1%.

EXAMPLE 7

Production of a Neodymium-Lanthanum-Iron Alloy:

The composition of the bath was as follows: $NdCl_3$:15%; $LaCl_3$:10%; LiCl:53%; LiF:22%.

The cathode was an iron bar, the ccd was 100 $A.dm^{-2}$, the acd was 142 $A.dm^{-2}$ and the interelectrode spacing was 40 mm. The temperature was 750° C. After t=1.5 $\underline{to}$, an alloy having the following composition was obtained, in a metal yield of 74%:Nd:55%; La:37%; Fe:9.2%, and Li:0.5%.

EXAMPLE 8

Production of a Praseodymium-Iron Alloy:

A bath having the following composition was used: $PrCl_3$:25%; LiCl:53%; LiF:22%. The cathode was of the same type as that used in Example 7, the ccd was 100 $A.dm^{-2}$, the acd was 140 $A.dm^{-2}$ and the interelectrode spacing was 45 mm. The temperature of the bath was 750° C. After t=1.5 $\underline{to}$, an alloy having the following composition was obtained: Pr:86%; Fe:12%; Li:0.5%. The metallic yield was 60%.

EXAMPLE 9

Production of Pure Lanthanum

A bath having the following composition was used: $LaCl_3$:30%; KCl:38.6%; LiCl:31.4%. The anode was graphite, while the cathode was lanthanum having a steel contact. The ccd was 55 $A.dm^{-2}$, the acd was 130 $A.dm^{-2}$ and the interelectrode spacing was 40 mm. The temperature of the bath was 690° C. After 3 hours, 31 minutes, 67 g of metal was obtained, the metallic yield being 56%.

EXAMPLE 10

This Example relates to the preparation of neodymium-iron alloys. The composition of the bath was varied. In all cases, the anode was graphite and the cathode was an iron rod.

The results are set forth in the following Table, in which:

T denotes the temperature of the bath in ° C., t denotes the duration of electrolysis, with respect to $\underline{to}$ as defined hereinbefore, $\underline{Di}$ denotes the interpole spacing, in millimeters, R denotes the yield of metal, as defined hereinbefore.

TABLE

| Bath composition | T | dc acd | dc ccd | t | Di | Contents Nd | Contents Fe | R Nd |
|---|---|---|---|---|---|---|---|---|
| 25 $NdCl_3$—53 LiCl—22 LiF | 750 | 150 | 100 | × 1.5 | 45 | 88 | 12 | 70 |
| 22 $NdCl_3$—47 LiCl—31 NaF | 750 | 100 | 100 | × 1.5 | 50 | 89 | 11 | 60 |
| 22 $NdCl_3$—48 LiCl—30 $CaF_2$ | 750 | 106 | 100 | × 1.5 | 55 | 87 | 13 | 54 |
| 25 $NdCl_3$—53 LiCl—22 LiF | 840 | 100 | 200 | × 1.5 | 28 | 86 | 14 | 77 |
| 25 $NdCl_3$—53 KCl—22 LiF | 840 | 100 | 100 | × 1.5 | 47 | 88 | 12 | 52 |
| 30 $NdCl_3$—62 KCl—8 NaF | 840 | 100 | 115 | × 1.7 | 55 | 87 | 13 | 31 |
| 26 $NdCl_3$—32 KCl—42 $BaF_2$ | 840 | 100 | 120 | × 1.3 | 58 | 88 | 12 | 21 |
| 25 $NdCl_3$—33 LiCl—20 NaCl—22 LiF | 740 | 100 | 140 | × 1.5 | 55 | 88 | 12 | 46 |
| 25 $NdCl_3$—53 LiCl—22 LiF | 830 | 100 | 250 | × 2 | 42 | 84 | 16 | 84 |
| 25 $NdCl_3$—53 LiCl—22 LiF | 840 | 100 | 200 | × 1.5 | 28 | 86 | 14 | 77 |
| 25 $NdCl_3$—53 LiCl—22 LiF | 820 | 64 | 100 | × 1.5 | 52 | 88 | 12 | 72 |
| 35 $NdCl_3$—46 LiCl—19 LiF | 830 | 115 | 250 | × 2.0 | 35 | 86 | 14 | 80 |

EXAMPLE 11

This Example relates to the preparation of a gadoliniumiron alloy.

A bath having the following composition was used: Gd $Cl_3$:26%; LiCl:52.3%; LiF:21.7%.

The anode was graphite and the cathode iron, while the temperature of the bath was 940° C., the acd was 89 $A.dm^{-2}$, the ccd was 250 $A.dm^{-2}$, and the interelectrode spacing was 46 mm. After t = 0.94 to, an alloy of the following composition was obtained: Gd:86%; Fe:14%. The metal yield was 42%.

The apparatus for carrying out the process of the invention will now be described.

The cell according to the invention is designed such as to permit the metal or the alloy formed to be poured or drawn off from the base or bottom thereof. Therefore, in its lower region, it comprises a draw-off or drain zone in which the product formed is collected by settlement, that zone being of such configuration or being provided with drain means such that it is possible for the metal or alloy to be easily removed.

Referring now to the Figures of Drawing, a cell 1 is shown which is comprised of an upper vessel 2, generally a cylindrical tank, and a lower member which is in the form of a conduit 3 and defining the drain zone. The drain zone has an internal cross section which is smaller than that of the upper tank and it preferably comprises a conduit which downwardly extends in vertical alignment with the longitudinal axis of the tank and advantageously has a cylindrical cross section. The conduit 3 preferably opens into the upper part of the cell 1 at the center of the base 4 thereof.

To facilitate pouring of the product, it is possible to provide a base 4 which is slightly inclined downwardly, for example, at an angle on the order of 10°.

The tank 2 of the cell 1 is provided with external heating means of the electrical radiant, contact or induction heating type, or of the gas or fuel oil burner type.

FIGS. 1 and 2 illustrate two particular embodiments of the drain zone.

Referring to FIG. 1, the drain zone or conduit 3 is comprised of three distinct zones, a connecting zone 5, a central zone 6 and an external zone 7. The central zone 6 is separated from the other two zones by valves 8 and 9 which provide for total opening and which are under remote control. The zone 6 which is thus defined constitutes a settlement space. The zones 5 and 6 are each provided with heating means, for example, of the electrical heating type.

As regards the dimensions involved, it may be noted that the diameter and the height of the zone 6 depend on the frequency with which draining is effected. Generally, the height of the zone 6 ranges from 2.5 to 6 times the height of the zone 5.

The drain zone 3 shown in FIG. 2 is also comprised of three zones, a connecting zone 10, a central zone 11 whose particular feature is that it has a cross section that is smaller than the remainder of the zone 3, and in particular the zone 10, and an external zone 12. The zone 12 is itself divided into two regions: region 13 adjacent to the zone 11 and an external region 14. These two regions are essentially distinguished from each other by virtue of the fact that they include independent heating means.

The zone 11 is also provided with heating means. For the regions 13 and 14, it is preferable to use electrical heating means which operate by contact or by radiation, and as regards the region 14, heating means operating by induction as an optional aspect and, for the zone 11, highly flexible heating means, for example, of the fuel oil or gas burner type.

The dimensions of the drain zone also depend on the frequency of draining of the cell. Preferably, the diameters of the zones 10 and 12 are identical and are in a ratio of approximately 2 to 4 with the diameter of the zone 11. As regards heights, it is possible to provide heights which are substantially close in regard to the zones 10 and 11 and the region 13, that of the conduit 3 being 3 to 5 times greater.

The entirety of the electrolysis cell is made of a material which is capable of withstanding the temperature of the bath and corrosion due to the different substances involved. A suitable material that is representative is cast iron, in particular grey iron with foliated or spheroidal graphite. It is also possible to use cast iron alloyed with chromium or nickel, or preferably molybdenum-silicon.

Different electrode forms and arrangements may be used in the cell according to the invention.

Generally, a graphite anode is employed. As regards the cathode, the nature thereof depends upon the type of product prepared, as has been noted hereinbefore: tungsten for a pure rare earth, or a consumable cathode of transition metal or rare earth-transition metal alloys, for the production of alloys.

Also generally, the cell employs a cylindrical cathode which is disposed vertically in the tank, preferably at the center thereof. Particularly when the drain zone of the cell comprises a cylindrical conduit, it is advantageous for the cathode to be disposed in vertical alignment with the conduit.

In a preferred embodiment of the invention, the cathode is hollow and cylindrical. It is also possible to provide for the cell to be supplied with rare earth chloride by way of the hollow central area of the cathode.

Finally, it is also envisaged to use a horizontal cathode. Different forms of anodes may be used:

As will be seen from FIG. 1, the anode may comprise one or more vertical cylinders 15 which are disposed around the cathode 16. It is possible to employ, for example, six cylinders 15.

In the FIG. 2 embodiment, the anode may also comprise a cylindrical ring 17 which is centered around the cathode 16. Instead of a ring, it is also possible to use ring sectors.

Lastly, it should be noted that the electrodes are advantageously disposed in the cell in such manner that the lower end of the cathode is closer to the bottom of the tank than the lower ends of the anode or anodes.

The operation of the aforesaid cell embodiments will now be described.

The cell is continuously supplied with rare earth chloride by way of a hopper. In the case of a hollow cathode of the type described hereinbefore, the chloride is introduced into the central region of the electrode.

The metal or alloy formed during the electrolysis operation falls to the bottom of the tank and is cyclically recovered in the drain zone.

In the case of the arrangement shown in FIG. 1, with the valve 8 being open and the valve 9 closed, the metal or alloy is allowed to fill the zone 6 completely. Once the filling operation is concluded, the valve 8 is closed and the valve 9 is opened to permit the product to flow by gravity into the external zone 7.

When using the arrangement shown in FIG. 2, the procedure is as follows: The region 14 of the zone 12 is maintained cold, that is to say, it is maintained at a temperature which is lower than the melting temperature of the bath, and the metal or alloy is permitted to settle in the region 13, the zones 10, 11 and 13 being heated. The zone 11 is then very quickly cooled and a plug of salt is formed therein. The external region 14 of the zone 12 is then rapidly heated to effect a pouring of the product which has collected in 13. The regions 13 and 14 are then cooled to form a fresh plug of salt in the zone 12 and the zone 11 is progressively heated.

It will be appreciated that the aforedescribed arrangement may be used for any type of electrolysis in a bath of molten salts, in which a final product is collected by settlement. The application thereof is therefore not limited to the baths which have been more particularly described hereinbefore.

While this invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the preparation of neodymium, or alloy thereof with another rare earth metal, or with a transition metal, comprising electrolyzing with solid electrodes a melt which comprises (i) neodymium chloride, (ii) lithium chloride, and (iii) lithium fluorides.

2. The process as defined by claim 1, said melt further comprising an iron chloride.

3. The process as defined by claim 1, said melt further comprising at least one iron, cobalt, nickel or chromium chloride.

4. The process as defined by claim 1, wherein the temperature of electrolysis ranges from 650° to 1,100° C.

5. The process as defined by claim 1, wherein the electrolysis is carried out under a chlorine partial pressure of at least $1.01 \cdot 10^4$ Pa.

6. A process for the preparation of neodymium, or alloy thereof with another rare earth metal, or with a transition metal, comprising electrolyzing with solid electrodes a melt which comprises (i) neodymium chloride, (ii) lithium chloride, and (iii) lithium fluoride, said melt comprising from 10 to 70% by weight of said neodymium chloride (i).

7. The process as defined by claim 6, said melt comprising at least 15% by weight of said lithium fluoride (iii).

8. A process for the preparation of neodymium, or alloy thereof with another rare earth metal, or with a transition metal, comprising electrolyzing with solid electrodes a melt which comprises (i) neodymium chloride, (ii) lithium chloride, and (iii) lithium fluoride, said melt comprising from 15 to 45% by weight of said neodymium chloride (i).

9. A process for the preparation of neodymium, or alloy thereof with another rare earth metal, or with a transition metal, comprising electrolyzing with solid electrodes a melt which comprises (i) neodymium chlorides, (ii) lithium chloride, and (iii) lithium fluoride, said melt comprising from 10 to 70% by weight of said neodymium chloride (i) and the ratio in the melt between lithium chloride (ii) and lithium fluoride (iii) ranging from 1.5:1 to 3:1.

10. A process for the preparation of neodymium-iron alloys comprising electrolyzing with solid electrodes a melt which comprises (i) neodymium chloride, (ii) lithium chloride, and (iii) lithium fluoride, the cathode of electrolysis comprising iron or alloy thereof with a rare earth metal.

11. A process for the preparation of neodymium-iron alloys comprising electrolyzing with solid electrodes a melt which comprises (i) neodymium chloride, (ii) lithium chloride, and (iii) lithium fluoride, the cathode of electrolysis comprising iron or alloy thereof with a rare earth metal and the anode of electrolysis comprising graphite.

12. A process for the preparation of an Nd-Fe alloy comprising electrolyzing with solid electrodes a melt which comprises (i) neodymium chloride, (ii) lithium chloride, and (iii) lithium fluoride.

13. A process for the preparation of neodymium, or alloy thereof with another rare earth metal, or with a transition metal, comprising electrolyzing with solid electrodes a melt which comprises (i) from 25 to 35% by weight of neodymium chloride, (ii) from 46 to 53% by weight of lithium chloride, and (iii) from 19 to 22% by weight of lithium fluoride.

* * * * *